US005503457A

United States Patent [19]

Rosado

[11] Patent Number: 5,503,457

[45] Date of Patent: Apr. 2, 1996

[54] COMBINATION LOUNGE AND STUDY CHAIR

[76] Inventor: Ralph Rosado, E. Croton Dr., R.D.4, Carmel, N.Y. 10512

[21] Appl. No.: 368,841

[22] Filed: Jan. 5, 1995

[51] Int. Cl.[6] ..... A47C 7/50

[52] U.S. Cl. ..... 297/448.1; 297/423.1; 297/170; 297/217.6

[58] Field of Search ..... 297/445, 446, 297/423.1, 170, 217.6, 423.15; D6/334, 360, 374, 375

[56] References Cited

U.S. PATENT DOCUMENTS 2,487,907 11/1949 Turner ..... 297/446 X 3,759,511 9/1973 Zinkin et al. ..... 297/423.1 X 4,690,459 9/1987 Ullman ..... 297/423.1 X

*Primary Examiner*—Peter R. Brown

*Attorney, Agent, or Firm*—Martin J. Spellman, Jr.

[57] ABSTRACT

A combination lounge and back posture work chair is disclosed which comprises a base seat support on a horizontal frame provided with back uprights, a folding foot support and a storable work support table. Downwardly extended frame sections of the back frame carry outwardly extending foot supports for when the user wishes to convert the use of the lounge chair to a working chair designed for promoting the user to work in an upright sitting position.

4 Claims, 7 Drawing Sheets

COMBINATION LOUNGE AND STUDY CHAIR

BACKGROUND OF THE INVENTION

1. Field of the Invention

This invention concerns a specially designed combination lounge and study chair wherein one can sit with the lower extremities supported in a horizontal position by the chair, formed like that of a conventional lounge chair. The chair is provided with a folding and adjustable foot rest and a support for work surfaces when used either in the lounge or working position. The back and horizontal base surfaces are padded and an overhead lamp is provided.

2. Prior Art

Representative multipurpose lounge chairs are shown in the following patents which were developed in a patentability search conducted for the Applicant:

| U.S. Pat. No. | Inventor | Title |
|---|---|---|
| U.S. Pat. No. 4,278,289 | Esposito | Fishing Chair |
| U.S. Pat. No. 4,392,685 | Leonhart | Combined Lawn Chair and Table Recliner |
| U.S. Pat. No. 4,506,925 | Crum | Footrest Mechanism for a Reclining Chair |
| U.S. Pat. No. 5,213,395 | Korteweg et al. | Adjustable Seating Assembly |
| U.S. Pat. No. 5,315,726 | Borenstein | Multipurpose Convertible Furniture Assembly |

The concept of an adjustable lounge chair with footrest and removable tray features are disclosed in these references, however none of them show a combination lounge chair which also can be utilized as a study chair promoting excellent posture for the user's back.

SUMMARY OF THE INVENTION

The present invention is concerned with a versatile lounge chair which is easily also beneficially useful for the back as a study working chair. It comprises base seat support on a horizontal frame provided with back uprights all of which are padded, a light, folding foot support, and storable work support table. Downwardly extended frame sections of the back frame of the chair which interiorly straddle the base support carry foot supports. The latter as used when the user wishes to convert the use of the lounge chair to a working chair especially designed for promoting the user to sitting upright to work. It is particularly beneficial for people who have chronic or perennial back problems.

BRIEF DESCRIPTION OF THE DRAWING

In the accompanying drawing which forms a part of this specification.

ILLUSTRATIVE SPECIFIC EMBODIMENT

Figure 1:
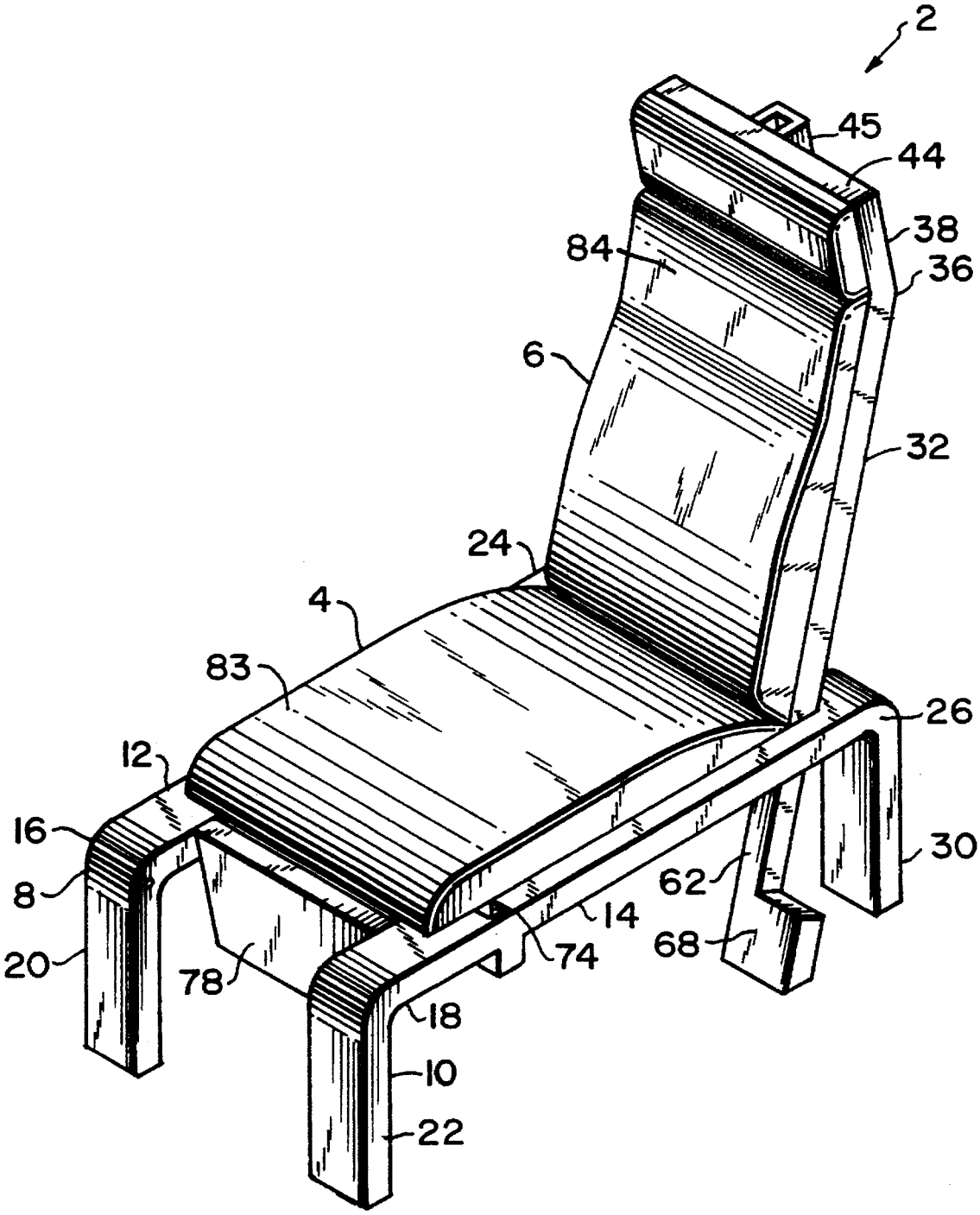
FIG. 1 is a perspective view of the basic couch and working chair of the present invention.
Figure 2:
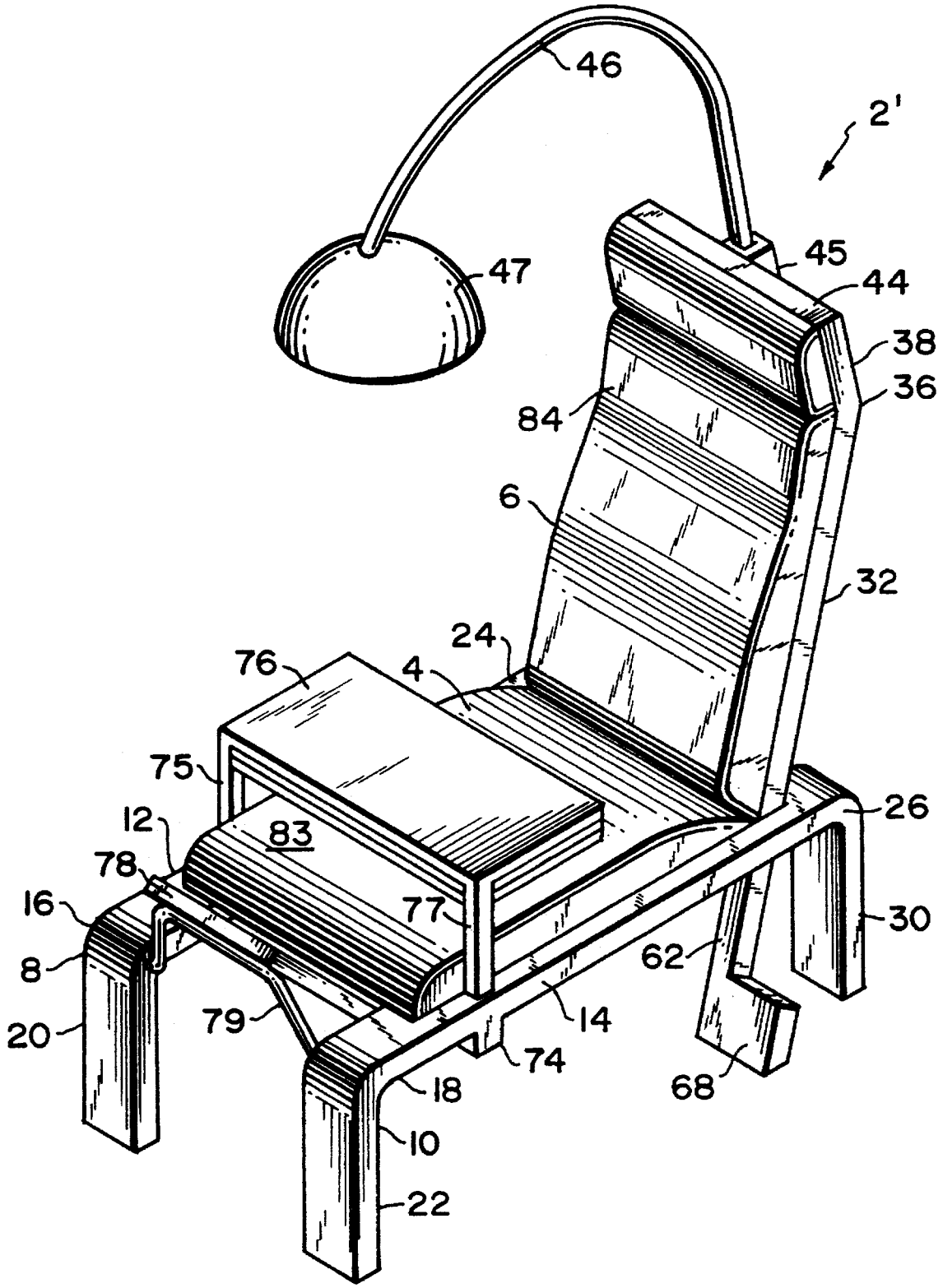
FIG. 2 is a perspective view of the lounge and chair combination of the present invention, configured for lounging, and with the light, footrest, and table attachments in place.
Figures 3, 3A:
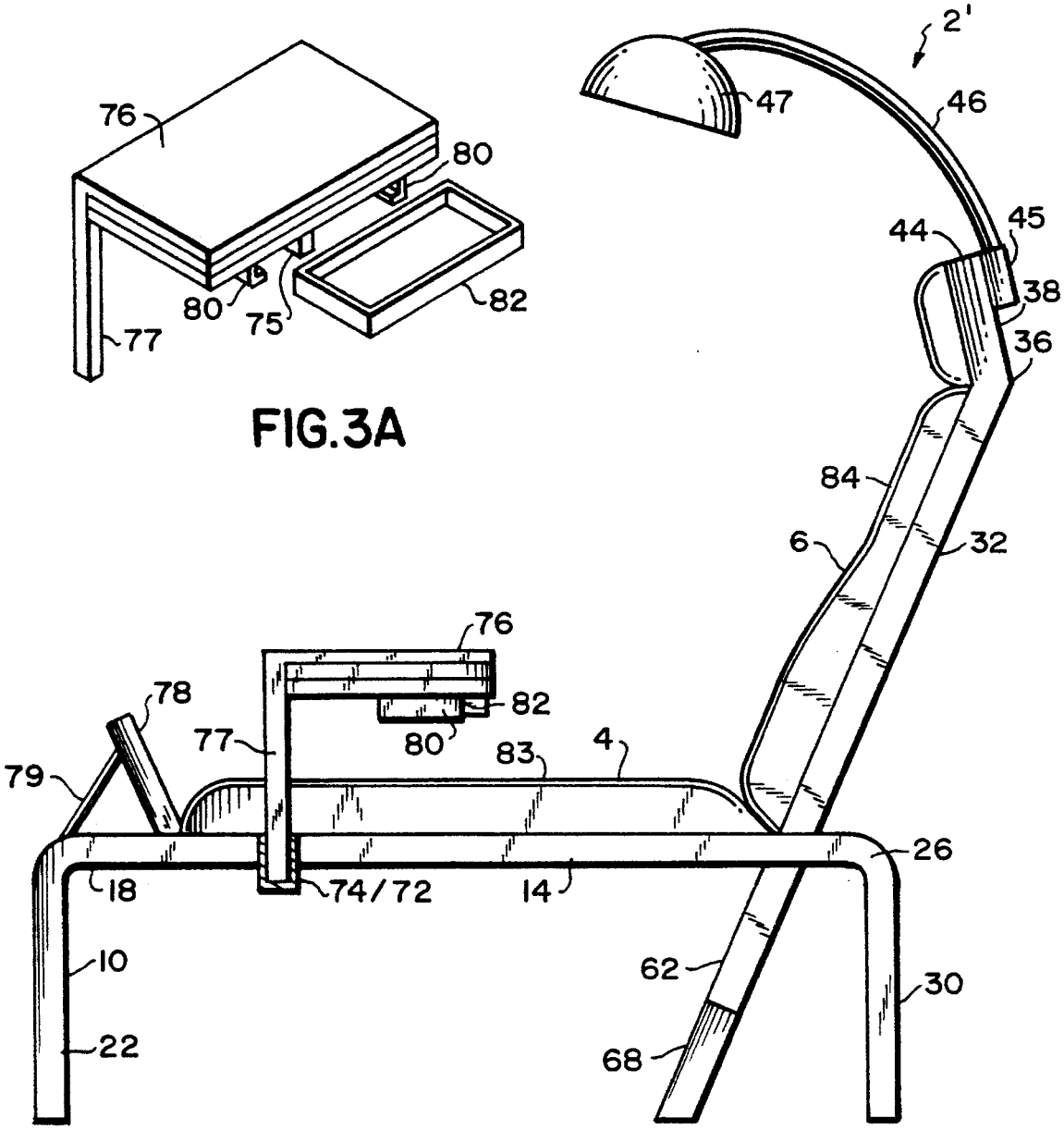
FIG. 3 is a left side elevational view of the chair in FIG. 1, the right side view being a mirror image of the left.
Figure 4:
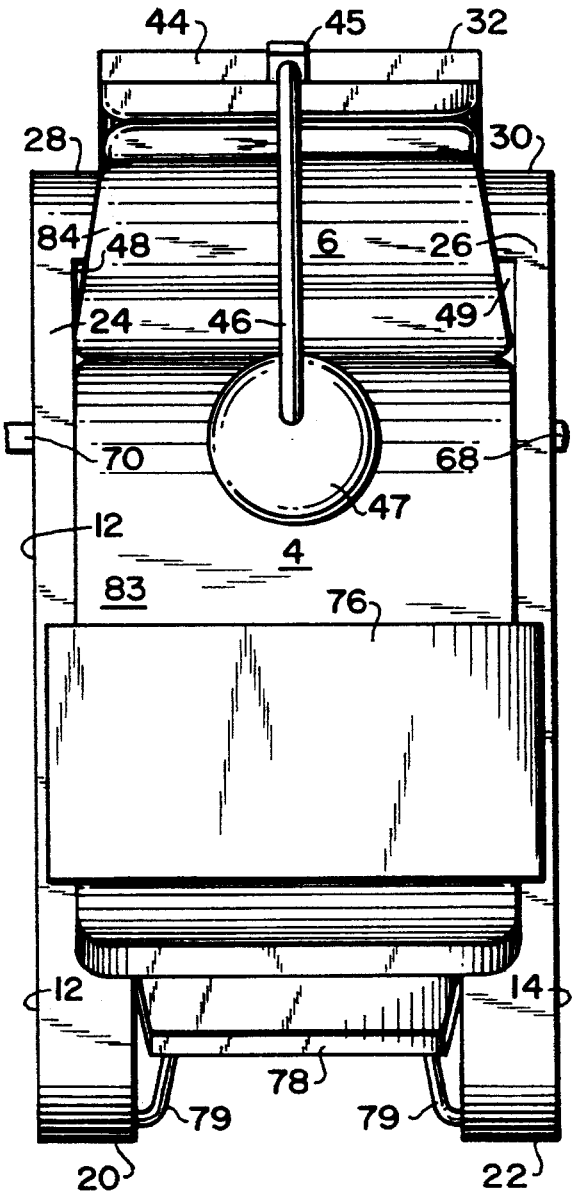
FIG. 4 is a top plain view of the chair.
Figure 5:
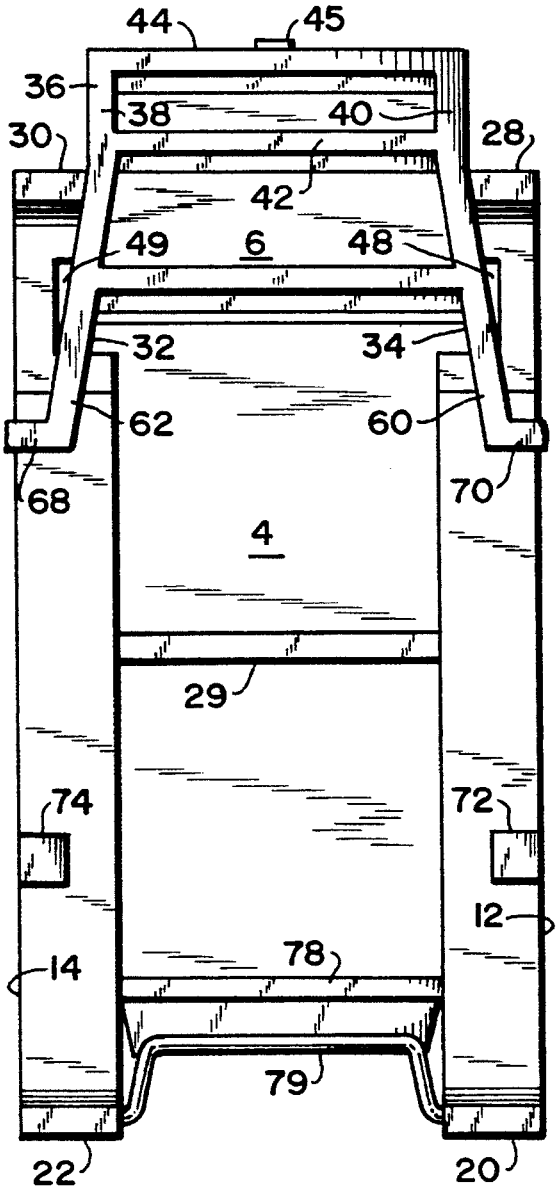
FIG. 5 is a bottom plain view thereof.
Figure 6:
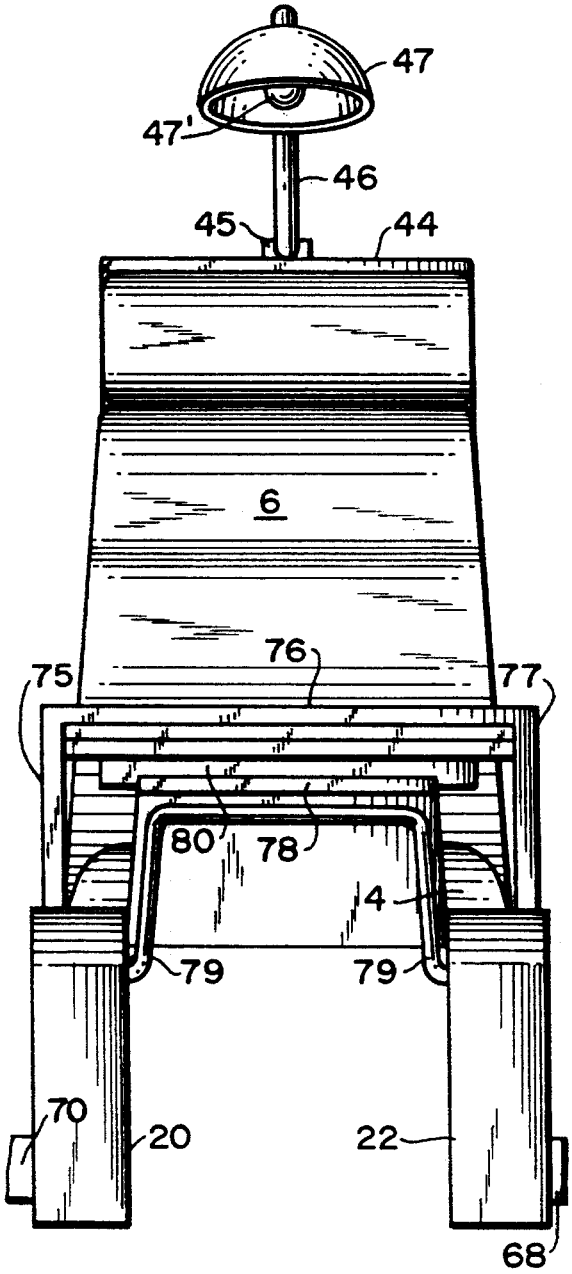
FIG. 6 is a front elevational view.
Figure 7:
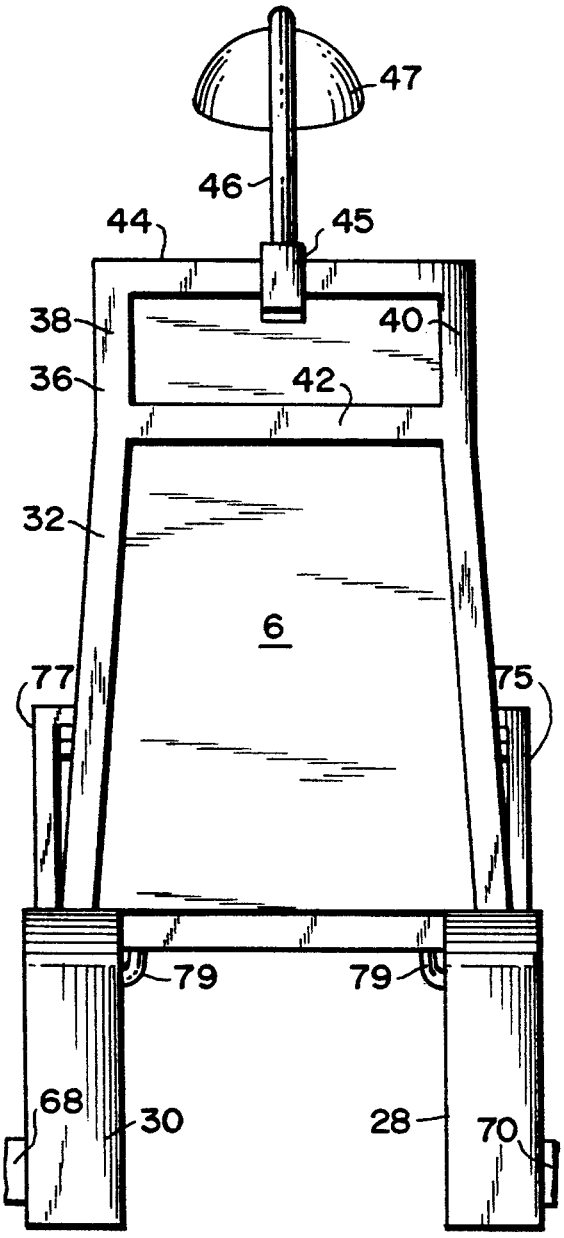
FIG. 7 is a rear elevational view.

Referring to FIG. 1 the basic chair 2 of the present invention is shown in an overall perspective view. In FIG. 2, the chair 2' is shown with added accessories including lamp 47, and work tray 46.

It may be constructed in general of wood, metal, or plastic materials. The chair includes a seat 4 and backrest 6. The seat 4 is mounted on and supported by spaced apart parallel base members 8 and 10 including horizontal beams 12 and 14 which at their forward ends 16 and 18 respectively form downwardly depending front legs 20 and 22 formed integrally therewith. The rear ends 24 and 26 respectively of the base members 12 and 14 have downwardly depending rear legs 28 and 30 respectively also formed integrally with beams 12 and 14.

The horizontal beams 12 and 14 are supported by cross beams 29.

The backrest 6 includes two upwardly extending frame members 32 and 34 which are tilted forwardly at the upper midpoint 36 and extend upwardly as members 38 and 40 that are angled slightly forward as shown best in the side view of FIG. 2. Cross frame members 42 and 44 connect frame members 32 and 34.

The frame members 32 and 34 are secured to the base beams 12 and 14 as indicated best in FIGS. 1 and 2, and extend upwardly from the base frame members 12 and 14 on the interior sides 46 and 48 of the base frame members 12 and 14. At the bottoms of 60 and 62 of members 32 and 34 thereof are footrests in the form of the laterally extending footrest blocks 68 and 70. These footrests 68 and 70 extend outwardly of the base frame members 12 and 14 to provide a comfortable rest for the feet of the user 103.

A fixture 72 and 74 is provided on either or both sides of the chair 2 on base 12 and 14 to removeably hold uprights 75 and 77 which support working table 76. The table 76 has a storage drawer 82 mounted on rails 80. The table 76 optionally may be removed when using the couch 2 as a working chair.

A tiltable and foldable footrest 78 is provided at the forward end of the seat 4 and is braced by support 79 which may be rotated to allow the rest 78 to fold down. The footrest 78 and bracket support 79 both are pivotally mounted between the base members 12 and 14 in a well known manner.

On the rear side 43 of the cross frame member 44 a fixture 45 is provided for removably holding the arm 46 for lamp 47 having bulb 47' which may be extended over the users head.

The seat 4 is provided with padded cushion 82 for comfort and the back rest 6 with padded cushion 84. A separate padded cushion 86 for the head rest portion of back 6 is also utilized.

Figure 8:
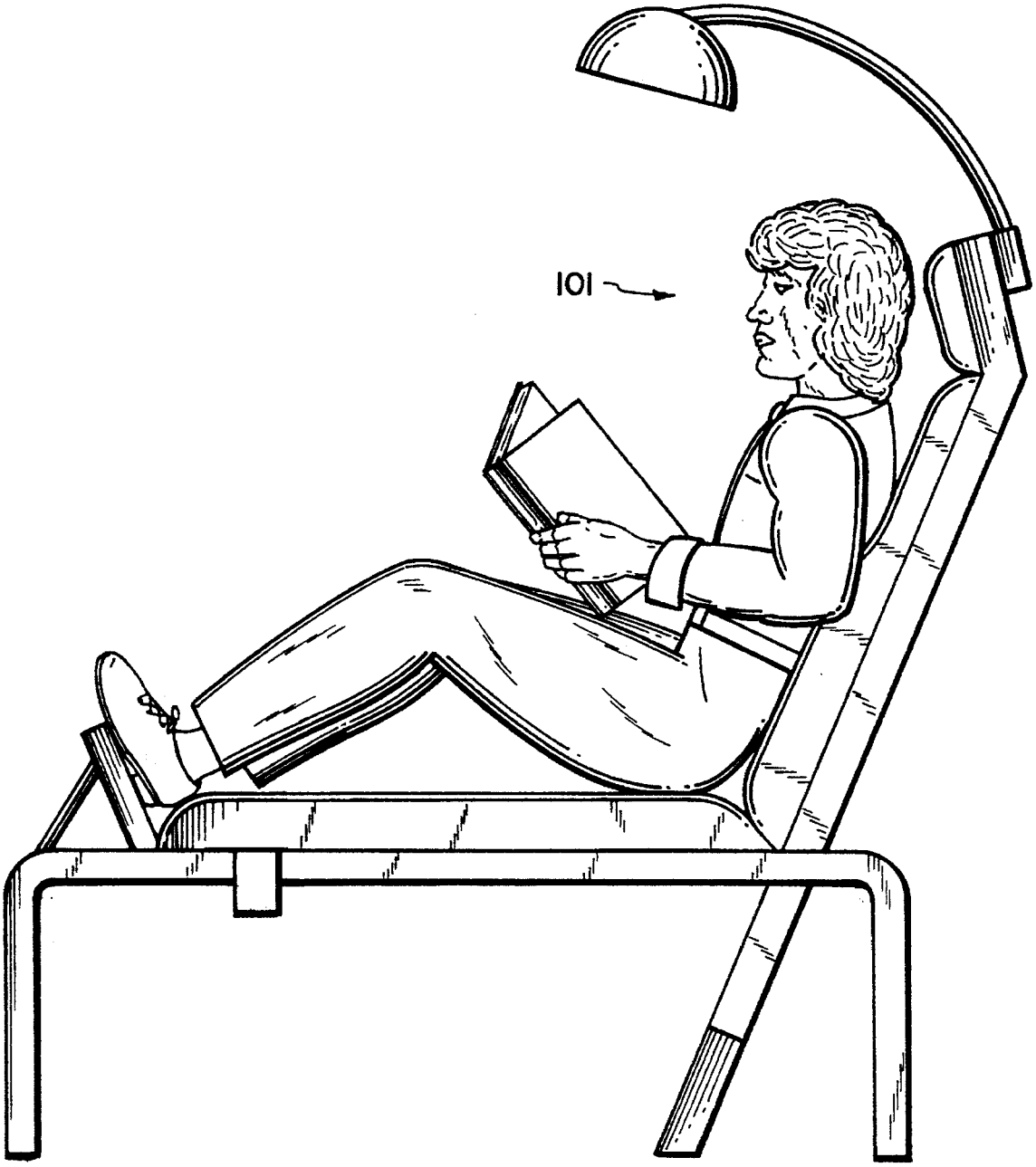
FIG. 8 is a side elevational view illustrating the chair with the work table removed and a user reading with her feet on the collapsible footrest.

In FIG. 8 the use of the chair/couch as a reading lounge is shown with user 101.

Figure 9:
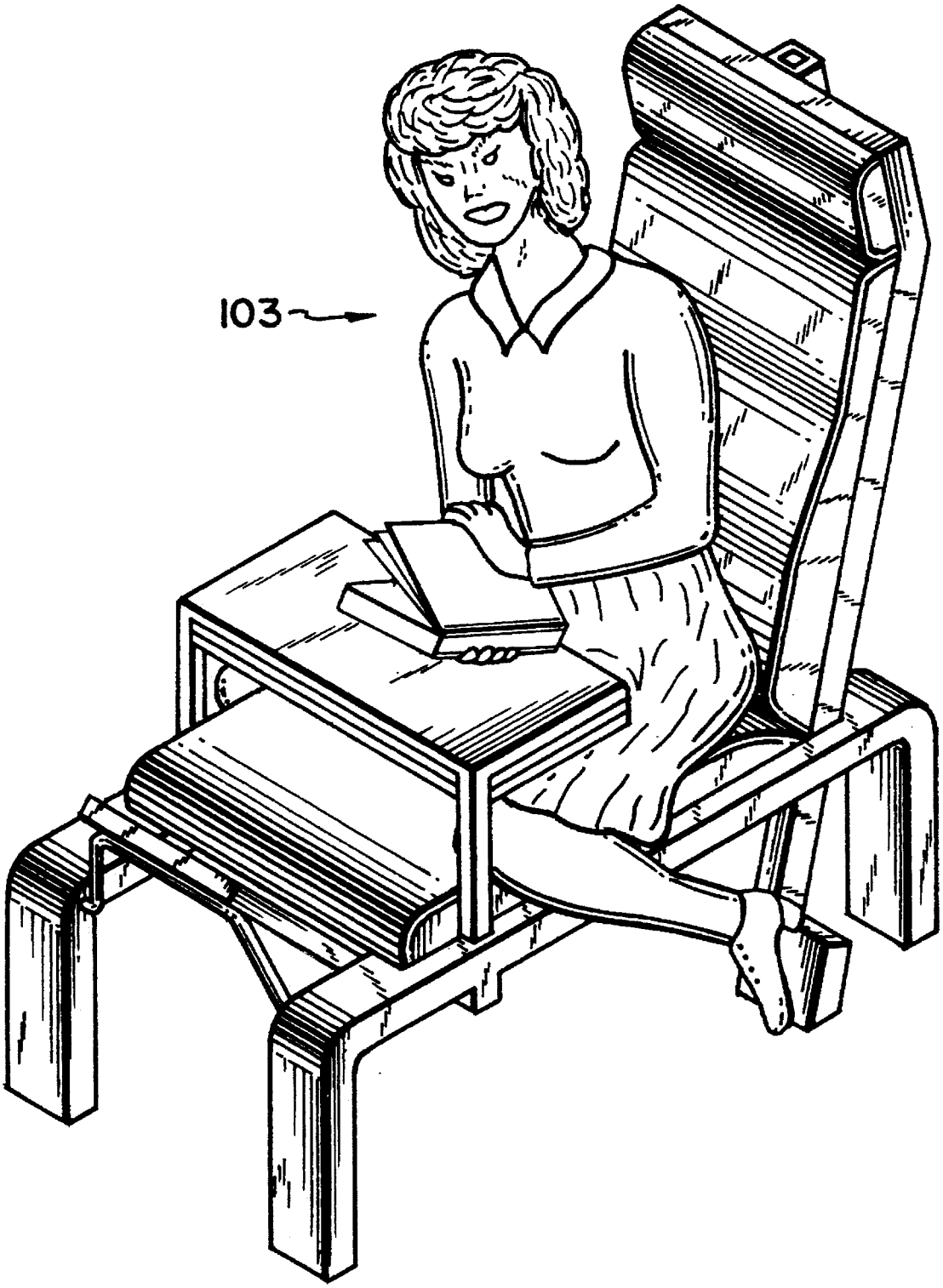
FIG. 9 is a perspective view of the chair with the lamp removed and being used as a sitting upright working/study chair.

Use of the couch as a work study chair is best shown in FIG. 9 wherein the lamp 47 and table 76 and footrest 78 have been removed or stowed and the user 103 is sitting on the seat 6 facing the front of the couch/chair 2 with her feet on the footrests 68 and 70.

It is well known that this style of sitting is excellent for maintaining the back and lessening fatigue when sitting doing "desk work" as opposed to conventional desk chairs. The height of the lounge chair 2 is such that it may easily fit under most desks and the width is proportioned so that a person can easily sit astride maintaining a upright position with his or her feet engaging the footrests 68 and 70 respectively at the base of the upright members 32 and 34.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A combination lounge and back posture work chair comprising two laterally spaced horizontal seat frame beams with depending front and rear legs each having a lower end, a backrest extending upwardly from said seat beams at a first end thereof, said backrest including laterally spaced back frame members extending upwardly and extending downwardly to lower portions on approximately the same horizontal plane as said lower ends of said legs, said lower portions of said back frame members having foot steps extending outwardly laterally from said back frame members beyond said seat frame beams.

2. A combination lounge and work chair as claimed in claim 1 wherein having a removable work table mounted towards the front of said base and a foldable foot step at the front end of said base.

3. A combination lounge and work chair as claimed in claim 2 having a lamp removably secured to said back rest.

4. A combination lounge and work chair as claimed in claim 1 wherein said base and said backrest have padded cushions thereon.

* * * * *